United States Patent [19]

Grosboll et al.

[11] Patent Number: 4,579,646

[45] Date of Patent: Apr. 1, 1986

[54] BOTTOMS VISBREAKING HYDROCONVERSION PROCESS

[75] Inventors: Martin P. Grosboll, Mokena; Paul H. Dittmar, Olympia Fields, both of Ill.

[73] Assignee: Atlantic Richfield Co., Los Angeles, Calif.

[21] Appl. No.: 630,462

[22] Filed: Jul. 13, 1984

[51] Int. Cl.[4] ..... C10G 47/02

[52] U.S. Cl. ..... 208/108; 208/53; 208/68; 208/73; 208/85; 208/95; 208/112

[58] Field of Search ..... 208/251 R, 68, 108, 208/106, 112, 50, 53, 211, 73, 85, 95

[56] References Cited

U.S. PATENT DOCUMENTS

| | | | |
|---|---|---|---|
| 3,161,585 | 12/1964 | Gleim et al. | 208/251 R |
| 3,238,117 | 3/1966 | Arey, Jr. et al. | 208/53 |
| 3,287,254 | 11/1966 | Paterson | 208/68 |
| 3,331,769 | 7/1967 | Gatsis | 208/210 |
| 3,738,931 | 6/1973 | Frankovich et al. | 208/68 |
| 4,090,947 | 5/1978 | Satchell, Jr. | 208/50 |
| 4,169,041 | 9/1979 | Schuette | 208/108 |
| 4,192,735 | 3/1980 | Aldridge et al. | 208/114 |
| 4,214,977 | 7/1980 | Ranganathan | 208/108 |
| 4,229,283 | 10/1980 | Sosnowski | 208/108 |
| 4,357,229 | 11/1982 | Bearden, Jr. et al. | 208/108 |
| 4,389,301 | 6/1983 | Dahlberg et al. | 208/149 |
| 4,400,264 | 8/1983 | Kwant et al. | 208/68 |
| 4,462,895 | 7/1984 | Biceroglu et al. | 208/59 |
| 4,483,762 | 11/1984 | Grosboll | 208/108 |

*Primary Examiner*—John Doll
*Assistant Examiner*—Anthony McFarlane
*Attorney, Agent, or Firm*—Donald L. Traut

[57] ABSTRACT

This invention relates to a process for hydroconverting a hydrocarbon chargestock having the steps of: heating the chargestock to produce a minor amount of coke; contacting the coke within the chargestock with a minor effective amount of an oil-soluble metal compound, the metal being selected from the group consisting of Groups IV-B, V-B, VI-B, VII-B, and VIII of the Periodic Table of Elements, and mixtures thereof; contacting the metal compound and the coke within the chargestock with a hydrogen-containing gas under conditions to produce a solid catalyst within the chargestock capable of promoting hydroconversion of at least a portion of the chargestock; contacting the chargestock containing the catalyst with hydrogen under hydroconversion conditions; and recovering a hydroconverted substantially-hydrocarbon product.

29 Claims, 1 Drawing Figure

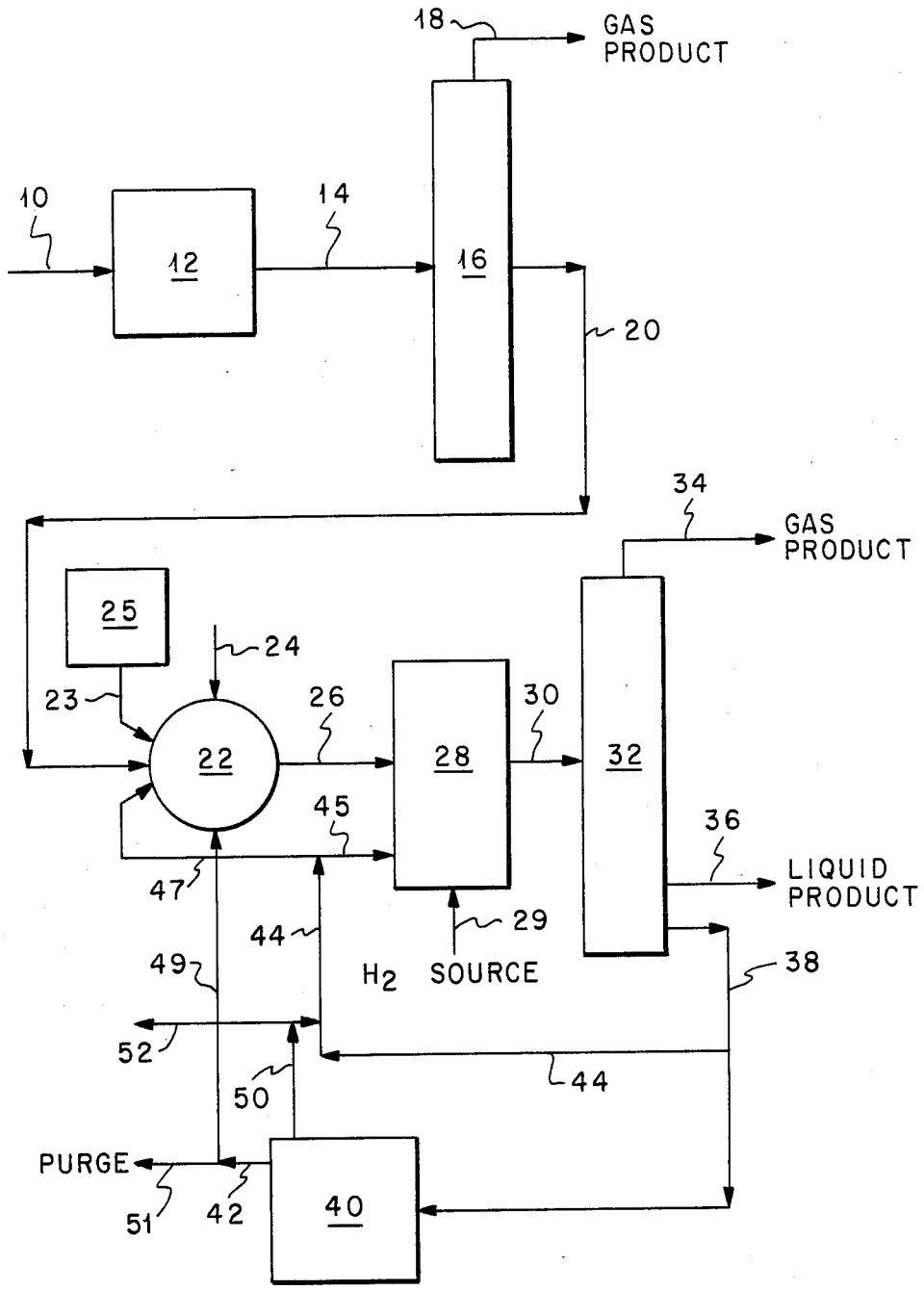
18
GAS PRODUCT
10
12
14
16
20
34
GAS PRODUCT
25
24
23
22
26
28
30
32
45
36
LIQUID PRODUCT
47
44
29
49
$H_2$ SOURCE
38
52
50
44
PURGE
51
42
40

BOTTOMS VISBREAKING HYDROCONVERSION PROCESS

FIELD OF THE INVENTION

This invention relates to a process for the hydroconversion of hydrocarbon fractions. More particularly, this invention relates to an improved process for such hydroconversion in the presence of one or more of a select group of molybdenum-containing catalysts.

PERTINENT ART

U.S. Pat. No. 4,192,735 teaches that minor amounts of an oil-soluble compound of metals of Group IV-B, V-B, VI-B, VII-B, and VIII of the Periodic Table of Elements, and their conversion products act as catalysts for the hydroconversion of hydrocarbonaceous oils. This patent teaches a preference for oil-soluble metal compounds of molybdenum, more preferably molybdenum naphthenate.

Improvements in this catalytic system would be beneficial. For example, increased catalyst activity and/or selectivity would reduce equipment sizes and/or produce more desirable and valuable products.

U.S. Pat. No. 3,816,301 teaches an improved process for preferentially oxidizing the sulfur in a hydrocarbon material in the presence of a certain class of molybdenum-containing catalysts to produce hydrocarbon products having reduced sulfur content.

One object of the present invention is to provide an improved hydroconversion process for hydrocarbon chargestocks.

Another object of the present invention is to provide an improved catalyst system for the hydroconversion of hydrocarbon chargestocks. Other objects and advantages of the present invention will become apparent hereinafter.

SUMMARY OF THE INVENTION

The process of the present invention includes the steps of: heating the chargestock to produce a minor amount of coke; contacting the coke within the chargestock with a minor effective amount of an oil-soluble metal compound, the metal being selected from the group consisting of Groups IV-B, V-B, VI-B, VII-B, and VIII of the Periodic Table of Elements, and mixtures thereof; contacting the metal compound and the coke within the chargestock with a hydrogen-containing gas under conditions to produce a solid catalyst within the chargestock capable of promoting hydroconversion of at least a portion of the chargestock; contacting the chargestock containing the catalyst with hydrogen under hydroconversion conditions; and recovering a hydroconverted substantially-hydrocarbon product.

The term "hydroconversion" is used herein to designate a catalytic process conducted in the presence of hydrogen in which at least a portion of a hydrocarbon fraction (chargestock) (e.g., the heavy or high boiling constituents and coke precursors, as measured by Conradson carbon residue, of the hydrocarbon fraction) is converted to lower boiling hydrocarbon products while simultaneously reducing the concentration of at least one, or preferably all, nitrogenous compounds, sulfur compounds and metallic contaminants.

BRIEF DESCRIPTION OF THE DRAWING

The FIGURE is a schematic flow plan of a preferred embodiment of the present invention.

DETAILED DESCRIPTION OF THE PREFERRED EMBODIMENT

The preferred embodiment will be described with reference to the accompanying FIGURE. Referring to the FIGURE, a hydrocarbon feed having an atmospheric pressure boiling point of about 650° to 1050° F. is introduced via line 10 into visbreaking zone 12. The visbreaking zone 12 is maintained at a temperature ranging from about 750° to about 850° F. and at a total pressure of from about 50 to about 500 psig. The visbreaking zone effluent is removed via line 14 and comprises a hydrocarbon intermediate charge, gases, and a minor amount of coke.

Typically, a hydrocarbon feed is subjected to a visbreaking process to produce hydrocarbon liquids and gases while avoiding coke formation. Coking operations which operate under much more severe conditions produce the maximum amount of solid product (i.e., coke). The severity of conditions is controlled by time/-temperature relationships. In the visbreaking zone of the present invention, a minor amount of coke is produced. Thus, the visbreaking process of the present invention maintains conditions at a severity level just below that necessary to gain a substantial increase in the carbonaceous coke solid formation.

The effluent is introduced into a first gas-liquid separator zone 16 from which hydrogen and light hydrocarbon gases are removed via overhead line 18. The hydrocarbon intermediate charge containing the dispersed coke emerges from separator zone 16 via line 20 and is introduced into catalyst mixing zone 22. A hydrogen-containing gas is introduced via line 23 to mixing zone 22 from a source 25. An oil-soluble metal compound is introduced via line 24 to mixing zone 22, thereby contacting the coke dispersed in the intermediate charge. The charge-catalyst stream is fed from mixing zone 22 via line 26 to hydroconversion zone 28. A gaseous mixture comprising hydrogen is introduced into hydroconversion zone 28 via line 29. The hydroconversion zone 28 is maintained at a temperature ranging from about 650° to about 1000° F., at a total pressure of from about 500 to about 5000 psig, and at a hydrogen gas feed rate of about 500 to about 5000 standard cubic feet per barrel (SCF/B) of hydrocarbon chargestock.

The hydroconversion zone effluent, comprising hydroconverted oil product, gases, and solid catalytic residue, is removed via line 30 and into a fractionation zone 32 where hydrogen and light hydrocarbons are removed via overhead line 34. A liquid product stream emerges from fractionation zone 32 via line 36.

A heavy liquid bottoms stream containing dispersed catalyst solids is removed via line 38 from fractionation zone 32. From the bottoms stream, a major portion of hydroconverted oil product is separated from the solids by means of centrifugation, filtration or a combination of settling and drawing-off, etc., in zone 40. Alternatively, the bottoms stream may be recycled via line 44 to line 45 to hydroconversion zone 28 or to line 47 to mixing zone 22. Liquid is removed from zone 40 via line 50 and solids are removed via line 42. A portion of the solids and any remaining associated liquid are purged from the process via line 51 to control the buildup of solids in the process or returned to mixing zone 22 via line 49. The liquid in line 50 reenters the process steps via line 44 or is removed to another processing apparatus via line 52.

Alternatively, the hydrocarbon feed may be introduced via line 10 into visbreaking zone 12, as described above, and which additionally incorporates introduction of a hydrogen-containing gas and the oil-soluble metal compound. In still an additional alternative, the oil-soluble metal compound may be introduced into the feed prior to the visbreaking zone 12. The hydrogen-containing gas is introduced into the visbreaking zone 12 as above. In the visbreaking zone 12, a minor amount of coke is produced which reacts immediately with the oil-soluble metal compound to form catalyst particles. The coked catalyst stream may then be fed from the visbreaking zone 12 to a first gas-liquid separator zone 16 from which hydrogen and light hydrocarbon gases are removed via an overhead line. The separator effluent is then introduced directly into a hydroconversion zone 28.

The metal compound useful in the preparation of the present catalyst may be in the form of lumps, sheets, foil or powder. The powdered material (e.g., having a particle size such that it passes through a 50 mesh sieve, preferably through a 200 mesh sieve, on the Standard Screen Scale) is preferred since it offers increased surface area per unit volume and an increased rate of solubilization.

In one embodiment, the process of the present invention is applicable to heavy hydrocarbonaceous oils. Suitable heavy hydrocarbonaceous oil chargestocks include heavy mineral oil; whole or topped petroleum crude oils, including heavy crude oils; polynuclear aromatics such as asphaltenes; residual oils such as petroleum atmospheric distillation tower resids (boiling above 650° F.) and petroleum vacuum distillation tower residium (vacuum resids boiling above about 1050° F.); tars; bitumen; tar sand oils; shale oils. The process is particularly well suited to heavy crude oils and residual oils which generally contain a high content of metallic contaminants (nickel, iron, vanadium) usually present in the form of organometallic compounds (e.g., metallomorphyrins), a high content of sulfur compounds, a high content of nitrogenous compounds, and a high Conradson carbon residue content. The metal content of such oils may range up to 2000 wppm or more and the sulfur content may range up to 8 weight percent or more. The API gravity of such feeds at 60° F. may range from about −5° API to about +35° API and the Conradson carbon residue content of the heavy feeds will generally be at least about 5 weight percent, preferably in the range of from about 5 to about 50 weight percent, more preferably from about 10 to about 50 weight percent (as to Conradson carbon residue content, see ASTM Test D-189-65). Preferably, the feedstock is a heavy hydrocarbon oil having at least 10 weight percent of material boiling above 1050° F. at atmospheric pressure, more preferably having at least about 25 weight percent of material boiling above 1050° F. at atmospheric pressure.

In an additional embodiment, the process of the present invention is applicable to a substantially-hydrocarbon chargestock boiling, at atmospheric pressure, in the range of from about 430° to about 1100° F., preferably in the range of from about 500° to about 1050° F., more preferably in the range of from about 650° to about 1050° F. These hydrocarbon chargestocks may be derived from any source such as petroleum, oil shale, tar sands, coal liquids. The Conradson carbon residue content of these chargestocks will generally range below 5 weight percent, preferably below 2 weight percent. By way of example, suitable hydrocarbon chargestocks for the process of the present invention include virgin gas oil, vacuum gas oil, coker gas oil, petroleum distillates, hydrocarbon oils derived from coal liquefaction processes, etc., and mixtures thereof. Preferably, the chargestock is a mixture of hydrocarbons boiling, at atmospheric pressure, in the range of from about 650° to about 1050° F. More preferably, the hydrocarbon chargestock is a substantially asphaltene-free oil. By "substantially asphaltene-free" is intended herein that the chargestock comprises less than about 1.0 weight percent asphaltenes.

The oil-soluble metal compound of this embodiment is selected from the group consisting of Groups IV-B, V-B, VI-B, VII-B, and VIII of the Periodic Table of Elements, and mixtures thereof. The oil-soluble metal compound is added in an amount sufficient to provide at least about 10 wppm, preferably from about 10 to about 2000 wppm, more preferably from about 25 to about 950 wppm, still more preferably from about 50 to about 700 wppm, and most preferably from about 50 to about 400 wppm, calculated as elemental metal, based on the weight of hydrocarbon chargestock.

In the preferred embodiment, the molybdenum compound prepared as described below is combined with the hydrocarbon chargestock so that the resulting mixture preferably includes from about 10 to about 2000 wppm, more preferably from about 50 to about 300 wppm, still more preferably from about 50 to about 200 wppm of molybdenum, calculated as elemental metal, based on the weight of hydrocarbon chargestock.

Various methods can be used to convert the molybdenum compound in the chargestock to a catalyst. One method (pretreatment) of forming a catalyst from the molybdenum compound of the present invention is to heat the mixture of the metal compound and the hydrocarbon chargestock to a temperature in the range of from about 600° to about 800° F. and at a pressure in the range of from about 500 to about 5000 psig in the presence of a hydrogen-containing gas. Preferably, the hydrogen-containing gas also comprises hydrogen sulfide. The hydrogen sulfide may preferably comprise from about 1 to about 90 mole percent, more preferably from about 2 to about 50 mole percent, still more preferably from about 3 to about 30 mole percent, of the hydrogen-containing gas mixture. The thermal treatment in the presence of hydrogen or in the presence of hydrogen and hydrogen sulfide is believed to convert the molybdenum compound to the corresponding catalyst. The resulting catalyst contained within the chargestock is then introduced into a hydroconversion zone which will be subsequently described.

A preferred method of converting the oil-soluble metal compound of the present invention to a catalyst is to react the solution of the compound in oil with a hydrogen-containing gas under hydroconversion conditions to produce the catalyst in the chargestock in situ in the hydroconversion zone. Preferably, the hydrogen-containing gas comprises from about 1 to about 10 mole percent, more preferably from about 2 to about 7 mole percent, hydrogen sulfide. The conversion of the metal compound in the presence of the hydrogen-containing gas or in the presence of the hydrogen and hydrogen sulfide is believed to produce the corresponding molybdenum catalyst.

The hydroconversion zone is preferably maintained at a temperature in the range of from about 650° to about 1000° F., more preferably from about 750° to about 900° F., and still more preferably from about 800° to about 875° F., and at a hydrogen total pressure in the range of from about 500 to about 5000 psig, more preferably from about 1000 to about 3000 psig. Contact of the chargestock catalyst under hydroconversion conditions in the reaction zone with the hydrogen-containing gas converts the metal compound to the corresponding metal catalyst in situ. The hydroconverted oil, possibly containing solids, is removed from the hydroconversion zone. The solids may be separated from the hydroconverted oil by conventional means, for example, by settling or centrifuging or filtration of the slurry or concentration techniques such as solvent extraction or vacuum distillation. At least a portion of the separated oil may be recycled directly to the hydroconversion zone or recycled to be combined with the hydrocarbonaceous oil chargestock or may be disposed of. The space velocity, defined as volume of chargestock per hour per volume of reactor (V/hr/V), may vary widely, depending on the desired hydroconversion level. Suitable space velocities may range broadly from about 0.1 to about 10 volume of oil feed per hour per volume of reactor, preferably from about 0.25 to about 6 V/hr/V, more preferably from about 0.5 to about 2 V/hr/V. The process of the present invention may be conducted either as a batch or as a continuous-type operation.

The visbreaking zone is preferably operated at a temperature of less than about 50° F., and preferably less than about 20° F., above the coking temperature of the hydrocarbon chargestock. More preferably, the amount of coke generated should not materially affect the overall yield of the hydroconversion process. Most preferably, the weight percent of coke to chargestock is less than about 1 weight percent. The preferred coke content of the visbreaking zone effluent ranges from about 10 to about 5000 ppm of the heated chargestock. More preferably, the content is from about 100 to about 2000 ppm.

The preferred coke useful in the preparation of the present catalyst should have a particle size of from about 1 to about 50 microns, preferably from about 1 to about 20 microns. This is preferred since it offers increased surface area per unit volume to interact with the oil-soluble metal compound.

In the preferred hydroconversion embodiment, the hydroconversion zone is preferably maintained at a temperature in the range of from about 700° to about 1000° F., more preferably from about 800° to about 900° F., and at a total pressure in the range of from about 100 to about 5000 psig, more preferably from about 500 to about 3000 psig. Hydrogen is introduced into the reaction zone at a gas feed rate of from about 300 to about 10,000 SCF/B, preferably at a gas feed rate of from about 1000 to about 5000 SCF/B, of hydrocarbon chargestock. Reaction time may vary widely. Suitable reaction times include from about 5 minutes to about 4 hours, preferably from about 10 minutes to about 2 hours, depending upon the desired degree of conversion.

In preparing the molybdenum-containing catalyst useful in the present invention, metallic molybdenum is interacted (i.e., comingled or contacted) with at least one peroxy compound (e.g., organic hydroperoxide, organic peroxide, organic peracid, hydrogen peroxide, and mixtures thereof) in the presence of at least one low molecular weight saturated alcohol, ether mono or polyhydroxy, containing from about 1 to 4 carbon atoms per molecule to solubilize at least a portion of the molybdenum metal. It is believed that the molybdenum metal reacts with the peroxy compound to form a compound or complex which is soluble in the saturated alcohol and remaining peroxy compound.

Typical peroxides, hydroperoxides and peracids useful in the preparation of the molybdenum-containing catalyst include, by way of example, hydrocarbon peroxides, hydrocarbon hydroperoxides and hydrocarbon peracids wherein the hydrocarbon radicals in general contain up to about 20 carbon atoms per active-oxygen atom. With respect to the hydrocarbon peroxides and the hydrocarbon hydroperoxides, it is particularly preferred that such hydrocarbon radical contain from about 4 to about 18 carbon atoms per active-oxygen atom, and more particularly from about 4 to about 10 carbon atoms per active-oxygen atom. With respect to the hydrocarbon peracids, the hydrocarbon radical is defined as that radical which is attached to the carbonyl carbon and it is preferred that such hydrocarbon radical contain from about 1 to about 12 carbon atoms, more preferably from about 1 to about 8 carbon atoms, per active-oxygen atom. It is intended that the term organic peracid include, by way of definition, performic acid.

Typical examples of hydrocarbon radicals are alkyls such as methyl, ethyl, butyl, t-butyl, pentyl, n-octyl and those aliphatic radicals which represent the hydrocarbon portion of a middle distillate of kerosene; cycloalkyl radicals such as mono and polymethylcyclopentyl; aryl radicals such as phenyl and naphthyl; cycloalkyl substituted alkyl radicals such as cyclohexyl methyl and ethyl; alkyl phenyl substituted alkyl radicals such as benzyl, methylbenzyl, caprylbenzyl, phenylethyl, phenylpropyl, naphthylmethyl and naphthylethyl; and alkaryl radicals such as xylyl, methylphenyl and ethylphenyl.

Typical examples of peroxy compounds are hydroxyheptyl peroxide, cyclohexanone peroxide, tertiary butyl peracetate, di-tertiary butyl diperphthalate, tertiary butyl perbenzoate methylethyl ketone peroxide, dicumyl peroxide, tertiary butyl hydroperoxide, di-tertiary butyl peroxide, p-methane hydroperoxide, pinane hydroperoxide, 2,5-dimethylhexane-2,5-dihydroperoxide, and cumene hydroperoxide; and organic peracids such as performic acid, peracetic acid, trichloroperacetic acid, perbenzoic acid, and perphthalic acid.

In order to obtain the maximum benefits of the present invention, the most preferred peroxy compound for use in the present invention is tertiary butyl hydroperoxide.

These peroxy compounds may also be substituted with groups such as halides, $-NH_2$, $-SH$, $$-\underset{|}{C}=O$$

and the like, which do not substantially interfere with the catalyst-forming process.

Hydrogen peroxide suitable for preparing the molybdenum-containing catalyst is preferably used in the form of an aqueous solution containing, for example, from about 10 to about 60 percent, preferably about 30 percent, by weight, of hydrogen peroxide.

Typical examples of low molecular weight monohydroxy alcohols which are suitable for use in the preparation of the present molybdenum-containing catalyst include methyl alcohol, ethyl alcohol, isopropyl alcohol, n-butyl alcohol, tertiary butyl alcohol, and the like. The low molecular weight polyhydroxy alcohols which are suitable include ethylene glycol, propylene glycol, 1,2-butyl glycol, and glycerol. In general, either mono or polyhydroxy alcohols containing from about 1 to about 4 carbon atoms per molecule are suitable. Although the presence of the lower alcohols (e.g., methyl alcohol and ethyl alcohol) produces faster solubilization of molybdenum, in order to maximize the benefit of the overall process of the present invention, it is preferred that the molybdenum metal be interacted with tertiary butyl hydroperoxide in the presence of tertiary butyl alcohol. If tertiary butyl alcohol is used as the saturated alcohol, it is preferred, to enhance molybdenum solubility, that the interaction mixture comprise additionally at least one mono or polyhydroxy alcohol containing from about 1 to about 16 carbon atoms per molecule and at least one primary hydroxy group, present in an amount of from about 1 to about 25 percent, by weight, of the total alcohol present. A particularly preferred alcohol mixture for use in combination with tertiary butyl alcohol is a stream of higher polyhydroxy alcohols having a molecular weight in the range of from about 200 to about 300 and containing from about 4 to about 6 hydroxy groups derived from propylene epoxidation and described in U.S. Pat. No. 3,573,226.

The relative proportions of peroxy compound and low molecular weight saturated alcohol employed in preparing the catalyst may vary over a broad range and are, therefore, not of critical importance to the present invention. Typically, the peroxy compound comprises from about 5 to about 50 percent by weight of the total peroxy compound and saturated low molecular weight alcohol used in catalyst preparation.

The molybdenum concentration in the catalyst mixture (i.e., the mixture comprising the dissolved or soluble molybdenum, excess peroxy compound and alcohol) often is within the range of about 15 ppm to about 5 percent, preferably in the range of about 1000 ppm to about 2 percent by weight of the total mixture. It may be desirable to prepare the catalyst in the presence of a solvent such as benzene or ethyl acetate in order to obtain the optimum molybdenum concentration in the final catalyst mixture. However, if this type of dilution is desired, it is preferred that an excess of tertiary butyl alcohol be maintained in the catalyst mixture for this purpose.

The molybdenum metal-peroxy compound interaction may be carried out at a wide range of temperatures; for example, temperatures within the range of from about 25° to about 150° C. Interacting pressures should be set to avoid extensive vaporization of the peroxy compound and alcohol. Typical interacting pressures may range from about 1 psia to about 100 psia. In many instances, atmospheric pressure may be used. After the interaction has been carried out for a desired length of time (e.g., from about 5 minutes to about 300 hours, preferably from about 15 minutes to about 6 hours), the product from the interaction may be filtered to separate the undissolved molybdenum from the catalyst mixture, which is thereafter suitable for use as a catalyst for the oxidation of sulfur impurities in hydrocarbon materials.

The following Examples illustrate more clearly the process of the present invention. However, these illustrations are not to be interpreted as specific limitations on the present invention.

EXAMPLE I

This Example would illustrate the preparation of the presently useful molybdenum compound.

A soluble (i.e., homogeneous) oxidation catalyst was prepared by combining 0.74 weight percent molybdenum powder with tertiary butyl hydroperoxide in the presence of tertiary butyl alcohol and a mixture of $C_{10}$ to $C_{15}$ glycols containing from 4 to 6 hydroxyl groups per molecule wherein at least one of the hydroxyl groups was primary. The weight ratio of tertiary butyl hydroperoxide to tertiary butyl alcohol to glycols was about 2.1:4.1. This combination was heated to reflux temperature with constant stirring and maintained at this temperature until all the molybdenum had dissolved.

EXAMPLE II

This Example would illustrate the hydroconversion of a heavy hydrocarbonaceous material. The hydrocarbon material, a benzene-soluble petroleum vacuum still residium (Initial Boiling Point 610° F., 15 percent overhead—962° F.), is combined with the molybdenum compound prepared in Example I to contain 500 ppm by weight of molybdenum, calculated as elemental metal. The mixture is heated to a temperature between 750° and 850° F. at a pressure between about 50 and 500 psig to produce a minor amount of coke. This heated mixture is then contacted with hydrogen and hydrogen sulfide at a total pressure of 2500 psig, at a temperature of 850° F., and a hydrogen gas feed rate of 3000 SCF/B of hydrocarbon for 30 minutes. Hydroconverted products would be recovered from the reaction mixture by conventional means (e.g., by flashing and distillation).

EXAMPLE III

This Example would illustrate the hydroconversion of a lighter hydrocarbon material—a light Arabian vacuum gas oil feed having a Conradson carbon residue content of 0.5 weight percent; 2 weight percent sulfur; and an API gravity of 22.4°. The feed is mixed with an amount of the molybdenum compound prepared in Example I at a concentration of 500 ppm by weight of the compound, calculated as elemental molybdenum. The mixture is heated to a temperature between 750° and 850° F. at a pressure between about 50 and 500 psig to produce a minor amount of coke. This heated mixture is then contacted with hydrogen and hydrogen sulfide at a total pressure of 2000 psig, at a temperature of 840° F., and a hydrogen gas feed rate of 1000 SCF/B of feed. Hydroconverted products would be recovered from the reaction mixture by conventional means (e.g., flashing and distillation).

The processes as set forth above are shown to be effective to convert metal compounds to the catalysts useful in the present invention.

While the present invention has been described with respect to various specific examples and embodiments, it is to be understood that the present invention is not limited thereto and that it can be variously practiced within the scope of the following claims.

The embodiments of this invention in which an exclusive property or privilege is claimed are defined as follows:

1. A process for hydroconverting a hydrocarbon chargestock comprising:

(a) heating said chargestock to produce a minor amount of coke;

(b) contacting said coke within said chargestock with a minor effective amount of an oil-soluble metal compound, said metal being selected from the group consisting of Groups IV-B, V-B, VI-B, VII-B, and VIII of the Periodic Table of Elements, and mixtures thereof;

(c) contacting said metal compound and said coke within said chargestock with a hydrogen-containing gas under conditions to produce a solid catalyst within said chargestock capable of promoting hydroconversion of at least a portion of said chargestock;

(d) contacting said chargestock containing said catalyst with hydrogen under hydroconversion conditions; and (e) recovering a hydroconverted hydrocarbon product.

2. The process of claim 1 wherein said oil-soluble metal compound comprises at least one molybdenum compound prepared by a method comprising interacting metallic molybdenum with at least one peroxy compound in the presence of at least one first alcohol containing from about 1 to about 4 carbon atoms per molecule to solubilize at least a portion of said metallic molybdenum.

3. The process of claim 2 wherein said peroxy compound is tertiary butyl hydroperoxide, said saturated alcohol is tertiary butyl alcohol, and said interaction takes place in the presence additionally of a second alcohol, containing from about 1 to about 16 carbon atoms per molecule and at least one primary hydroxy group present in an amount sufficient to enhance the solubility of said molybdenum compound.

4. The process of claim 1 wherein said oil-soluble metal compound is a molybdenum compound and is converted to said catalyst in the presence of said hydrogen-containing gas under hydroconversion conditions, thereby forming said catalyst in said chargestock in situ under hydroconversion conditions.

5. The process of claim 2 wherein said interaction occurs at a temperature within the range of from about 25° to about 150° C.

6. The process of claim 2 wherein said molybdenum compound is combined with said chargestock in an amount equal to at least about 10 ppm by weight, calculated as elemental molybdenum, based on said chargestock.

7. The process of claim 6 wherein said amount of said molybdenum compound combined with said chargestock comprises between about 10 ppm and about 2000 ppm by weight.

8. The process of claim 7 wherein said amount of said molybdenum compound combined with said chargestock comprises between about 25 ppm and about 950 ppm by weight.

9. The process of claim 1 wherein said chargestock has a Conradson carbon residue content of less than about 5 weight percent.

10. The process of claim 1 wherein said chargestock has a Conradson carbon residue content of more than about 5 weight percent.

11. The process of claim 1 wherein said hydrogen-containing gas comprises hydrogen and hydrogen sulfide.

12. The process of claim 11 wherein said hydrogen-containing gas comprises hydrogen sulfide.

13. The process of claim 1 wherein said coke comprises from about 10 to about 5000 ppm of said heated chargestock.

14. The process of claim 13 wherein said coke comprises from about 100 to about 2000 ppm of said heated chargestock.

15. The process of claim 1 wherein said coke comprises particles ranging from about 1 to about 50 microns in diameter.

16. The process of claim 15 wherein said coke comprises particles ranging from about 1 to about 20 microns.

17. The process of claim 1 wherein said product comprises a hydroconverted oil containing catalytic solids, and additionally comprising separating at least a portion of said catalytic solids from said hydroconverted oil and recycling at least a portion of said catalytic solids to step (a) or to step (c).

18. The process of claim 1 wherein step (b) occurs simultaneously with step (a).

19. The process of claim 18 wherein step (c) occurs simultaneously with step (a) and (b).

20. The process of claim 19 wherein said oil-soluble metal compound comprises at least one molybdenum compound prepared by a method comprising interacting metallic molybdenum with at least one peroxy compound in the presence of at least one first alcohol containing from about 1 to about 4 carbon atoms per molecule to solubilize at least a portion of said metallic molybdenum.

21. The process of claim 19 wherein said molybdenum compound is combined with said chargestock in an amount equal to at least about 10 ppm by weight, calculated as elemental molybdenum, based on said chargestock.

22. The process of claim 21 wherein said amount of said molybdenum compound combined with said chargestock comprises between about 10 ppm and about 2000 ppm by weight.

23. The process of claim 22 wherein said amount of said molybdenum compound combined with said chargestock comprises between about 25 ppm and about 950 ppm by weight.

24. The process of claim 19 wherein said hydrogen-containing gas comprises hydrogen and hydrogen sulfide.

25. The process of claim 24 wherein said hydrogen-containing gas comprises hydrogen sulfide.

26. The process of claim 19 wherein said coke comprises from about 10 to about 5000 ppm of said heated chargestock.

27. The process of claim 26 wherein said coke comprises from about 100 to about 2000 ppm of said heated chargestock.

28. The process of claim 19 wherein said coke comprises particles ranging from about 1 to about 50 microns in diameter.

29. The process of claim 28 wherein said coke comprises particles ranging from about 1 to about 20 microns.

* * * * *